United States Patent [19]

Spingath, Jr.

[11] Patent Number: 4,621,987

[45] Date of Patent: Nov. 11, 1986

[54] PLUNGER APPARATUS

[75] Inventor: Benjamin F. Spingath, Jr., Bakersfield, Calif.

[73] Assignee: William Swaim, Bakersfield, Calif. ; a part interest

[21] Appl. No.: 709,314

[22] Filed: Mar. 7, 1985

[51] Int. Cl.[4] ..... F04B 39/16; F04B 21/04

[52] U.S. Cl. ..... 417/313; 417/554; 92/78

[58] Field of Search ..... 417/545, 554; 92/78

[56] References Cited

U.S. PATENT DOCUMENTS

| | | | |
|---|---|---|---|
| 1,466,685 | 9/1923 | Warner . | |
| 1,488,987 | 4/1924 | Hulsey . | |
| 1,499,690 | 7/1924 | Pine et al. . | |
| 1,548,805 | 8/1925 | Mowrey . | |
| 1,574,292 | 2/1926 | Kelley . | |
| 1,832,346 | 11/1931 | Yerkes et al. . | |
| 1,840,493 | 1/1932 | Dyer et al. . | |
| 1,867,320 | 7/1932 | McEvoy | 417/545 |
| 1,971,270 | 8/1934 | McGregor . | |
| 2,065,051 | 12/1936 | Cark et al. | 417/554 |
| 2,300,009 | 10/1942 | Rose | 92/78 |
| 2,306,560 | 12/1942 | Pendleton . | |
| 2,371,846 | 3/1945 | Ruthven . | |
| 2,506,790 | 5/1950 | Ihrig et al. | 92/78 |
| 2,837,032 | 6/1958 | Horsting | 92/78 |
| 3,244,112 | 4/1966 | Parkin . | |
| 3,267,872 | 8/1966 | Bloudoff . | |
| 3,592,567 | 6/1971 | Tolbart | 417/554 |
| 3,773,441 | 11/1973 | Schertz . | |
| 4,013,387 | 3/1977 | Gage | 417/554 |
| 4,084,925 | 4/1978 | Stroud et al. . | |

FOREIGN PATENT DOCUMENTS

| | | | |
|---|---|---|---|
| 527556 | 6/1977 | U.S.S.R. | 92/78 |

*Primary Examiner*—William L. Freeh

*Attorney, Agent, or Firm*—Worrel & Worrel

[57] ABSTRACT

A plunger apparatus for pumping fluid in a well having a tubular barrel, the apparatus providing an upper portion adapted to be secured on a tubing string for axial movement within the barrel, the upper portion providing a bore axially therethrough and mounting a filter element in communication with a plurality of passages communicating transversely through the upper portion from the bore to an interface defined between the exterior surface of the upper portion and the well barrel; an elongated, sleeve-like intermediate portion secured on the upper portion and providing a bore axially therethrough; and a lower portion secured on the intermediate portion and providing a bore axially therethrough and mounting a valve member internally of the bore; and a plurality of sealing members circumscribing the upper portion and lower portion and bounding the interface defined between the apparatus and the well barrel.

2 Claims, 4 Drawing Figures

PLUNGER APPARATUS

BACKGROUND OF THE INVENTION

1. Field of the Invention

The present invention relates to a plunger for use in an oil well and more particularly to such a plunger which is adapted for deployment on the lowermost terminus of a tubing string in a "sucker rod"-type oil pumping assembly for reciprocation thereof within a tubular barrel.

2. Description of the Prior Art

The use of oil wells having reciprocating plunger mechanisms has long been known. Typically, such wells are constructed having an actuating assembly deployed upon the surface of the ground which is commonly constructed in the manner of a walking beam. An elongated tubular barrel extends downwardly into the ground and communicates through oil-bearing subsurface strata, and an elongated rod or tubing string is mounted by the walking beam for axial reciprocation thereof by the beam within the tubular barrel. A plunger assembly is typically borne by the string for reciprocation therewith to effect a lifting of oil from the lowermost reaches of the barrel toward the surface.

The oil sought to be pumped from the well is commonly found deposited in reservoir rock which often is of an unconsolidated nature, similar to beach sand. The rock, in an unconsolidated state, has a tendency to be carried in and flow with the formation fluids and to be elevated with such fluids by action of the plunger and tubing string assembly. Such particulate matter often accumulates between the plunger assembly and the tubular barrel, causing damage to the plunger as well as the barrel and often necessitating removal of the pump from the well to permit the servicing, repair or exchange of damaged parts.

In some regions, contamination of the well with sand and the like is extremely common, in some cases necessitating the removal of the well assembly for repair and replacement on as frequent as a daily basis. The consequence of such damage, together with the removal of the tubing string and plunger, are costly in terms of both time and money. With some well bores extending in a range of from about 3,000 to 7,000 feet and more below the surface, the removal and replacement of the plunger assembly is a time-consuming process. Economically, the consequences of break-downs of the assembly include increased labor costs, the cost of replacement parts, and the loss of oil which would otherwise have been pumped during the "downtime" period during which the well is not in operation.

Various attempts have been made in the art to provide plunger assemblies and pumps constructed to overcome the susceptibilities of plungers to contamination from sand and other fine particulate matter. However, most such assemblies have been deficient in one or more respects. Some are simply almost totally ineffective at preventing the interposition of particulate matter in the interface between the plunger exterior surface and the tubular barrel interior surface. Others are constructed in such a manner that, while performing more effectively than the majority of commonly employed plungers, they nevertheless, when damaged or deteriorated, must be replaced substantially as a unit, thereby negating an appreciable portion of the cost savings which might otherwise be realized by their use.

Therefore, it has long been known that it would be desirable to have an improved plunger of simple, yet effective, construction and which is operable to exclude both fine and coarse particulate matter from the space between the exterior surface thereof and the interior surface of a typical well barrel, and further which is characterized by the ease of replacement and inexpensiveness of its component elements.

OBJECTS AND SUMMARY OF THE INVENTION

Therefore, it is an object of the present invention to provide an improved plunger apparatus adapted to be mounted for reciprocating movement thereof within an oil well barrel or the like.

Another object is to provide such an apparatus which is adapted, in operation, to prevent the entry of not only coarse particulate matter but also the finest of particles between the exterior surface thereof and the interior surface of the barrel through which it travels.

Another object is to provide such an apparatus which is effective in extending the period between times when the plunger becomes contaminated with sand and other particulate matter.

Another object is to provide such an apparatus which, in operation, results in a significant time and cost savings by reducing the need for repair and replacement of its component parts.

Another object is to provide such an apparatus which is capable of rapid and simple disassembly thereof to permit ease of exchange of portions thereof.

Another object is to provide such an apparatus which is adapted to exclude even micronic and submicronic particles from fluid delivered into the interface between the plunger and the tubular barrel.

Another object is to provide such an apparatus which is adapted to be constructed in a wide variety of dimensions for use in a large range of differing oil wells.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

First Form

Figure 2:
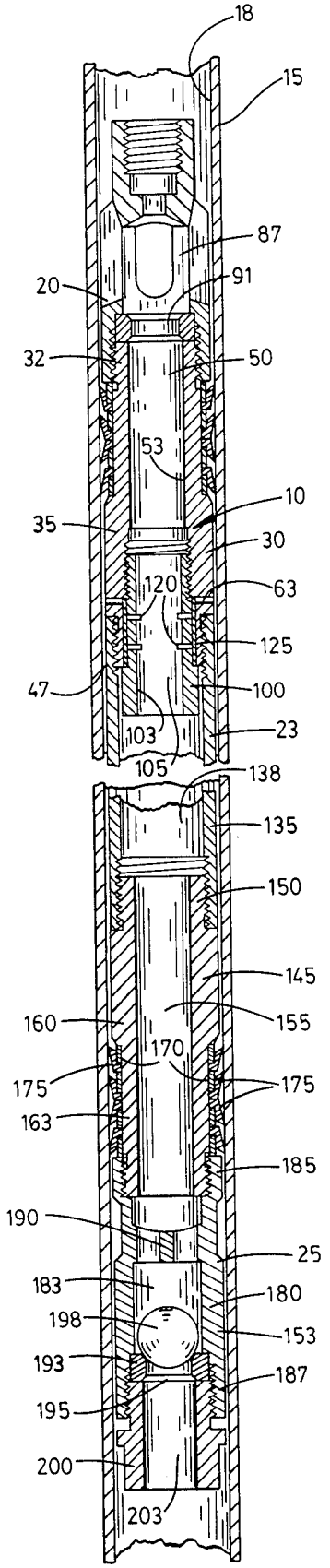
FIG. 2 is a longitudinal section of an apparatus incorporating the upper portion depicted in FIG. 1, deployed in a typical operational environment within a tubular well barrel.

A first form of the plunger apparatus embodying the principles of the present invention is designated generally by the numeral 10 in FIG. 2. As shown therein, the apparatus 10 is depicted deployed in a typical operational environment within a tubular, substantially cylindrical barrel 15 typical in its construction of those commonly employed within the bores of oil wells. The barrel is substantially symmetrical about a longitudinal axis and provides a substantially smooth, internal surface 18 of substantially cylindrical configuration having a predetermined diameter.

The apparatus 10 generally provides a predetermined first or upper portion 20; a second or intermediate portion 23; and a third or lower portion 25.

Figure 1:
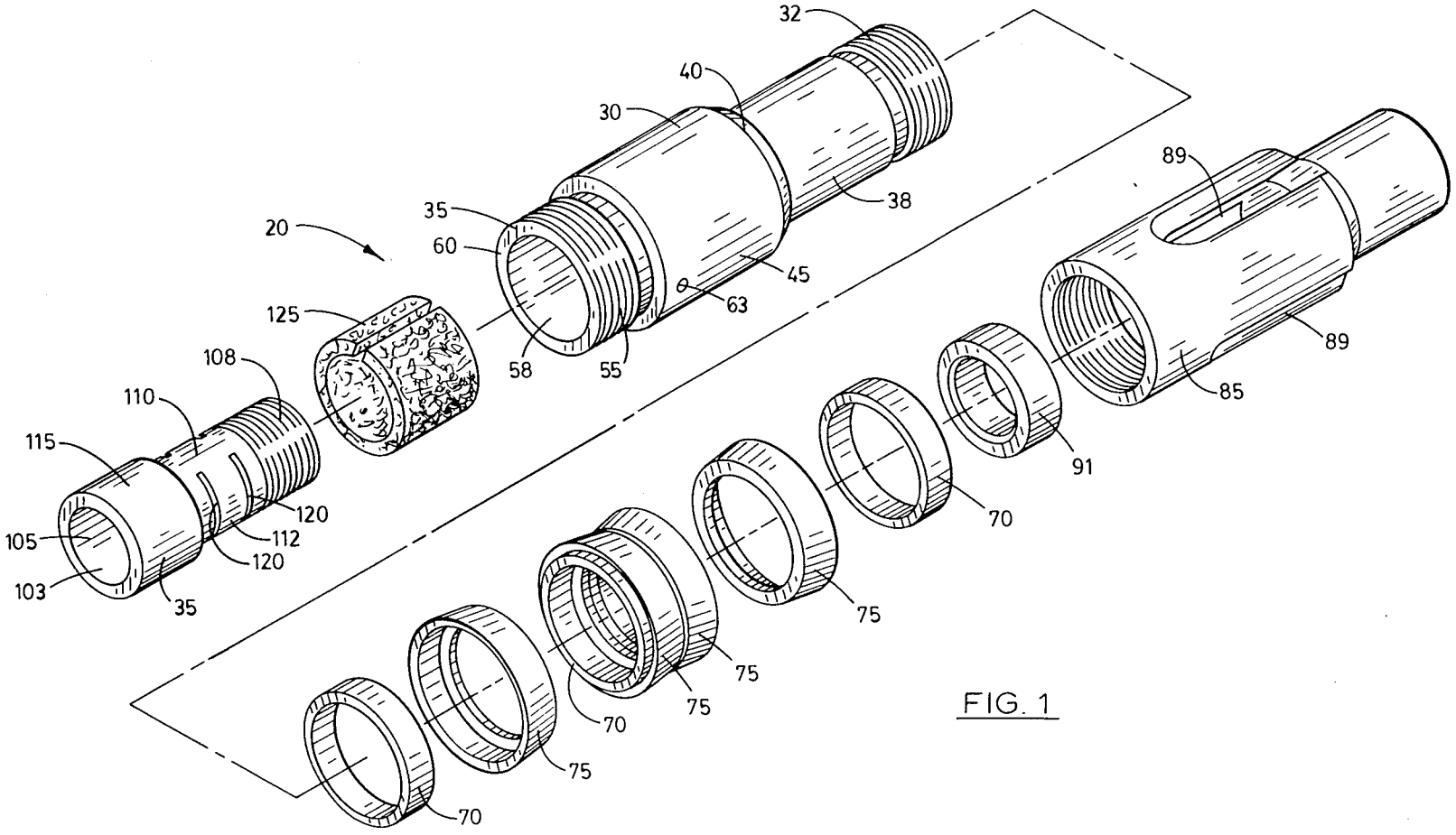
FIG. 1 is an exploded view of the upper portion of a first form of an apparatus embodying the principles of the present invention.

The upper portion 20 is shown somewhat enlarged in an exploded view in FIG. 1. As can best be seen therein, and as also shown most clearly in FIG. 2, the upper portion 20 provides a mandril member 30 having a first or cage-mounted end portion 32 and an opposite, second or filter-mounting end portion 35. The cage-mounting end portion 32 is externally screw-threaded distally of the filter-mounting end portion 35. The cage-mounting end portion 32 further provides a substantially cylindrical neck 38 of predetermined outside diameter terminating on a shoulder 40 of greater diameter than that of the neck 38.

The filter-mounting portion 35 has a substantially cylindrical external surface 45 of predetermined diameter, the diameter being largely dependent upon the internal diameter of the barrel 15 in which the apparatus 10 is intended to move, as is hereafter described in greater detail. Preferably, the outside diameter of the filter-mounting portion 35 is slightly less than that of the internal diameter of the barrel 15, whereby an interface or space 47 is defined between the external surface 45 and the internal surface 18 of the barrel to permit substantially loose axial movement of the apparatus 10 within the barrel. A bore 50 is defined by an internal surface 53 of the upper portion 20 and communicates completely axially therethrough.

The filter-mounting portion 35 further provides an externally screw-threaded union 55 of lesser external diameter than that of the external surface 45. The union 55 provides a substantially smooth, cylindrical internal surface 58 of predetermined diameter bounding the bore. The union 55 terminates in an annular lowermost edge 60.

The internal surface 53 defining the bore 50 is internally screw-threaded along a portion of its length extending from the uppermost edge of the internal surface 58 of the screw-threaded union 55 toward the neck portion 38. Preferably, although not necessarily, the screw-threaded portion of the internal surface is slightly tapered in a substantially upwardly convergent manner. The internal surface 58 of the union 55 is of greater diameter than that of the screw-threaded portion of the internal surface bounding the bore 50.

Preferably, at least two transverse bores 63 are provided communicating radially between the bore 50 and the external surface 45. The bores 63 communicate through the screw-threaded portion of the internal surface and are disposed in spaced apart relation to each other. In the preferred embodiment, the bores 63 are disposed substantially diametrically oppositely of each other.

A plurality of annular spacer rings 70 are slidably removably received upon the neck 38 of the mandril member 30. A corresponding number of substantially annular sealing members or cup members 75 are recieved on the neck 38 in substantially closely circumscribing relation to the spacer rings 70. Each cup member 75 provides a first portion 77 dimensioned slidably to be received about the neck 38 in substantially close-fitting, circumscribing relation thereto and a second portion 80 extending from the first portion slightly obliquely or outwardly divergently, whereby upon deployment of the cup member 75 on the neck portion 38, the second portions 80 of the cup members taper outwardly from the neck portion. As can best be seen in FIG. 3, the cup members 75 can be deployed to dispose the second portions 80 thereof in either upwardly or downwardly extending or facing relation relative to the first portions 77. Preferably, the cup portions 75 are constructed of a resilient, synthetic, durable material, and are dimensioned such that, when deployed in an operational attitude, such as that shown in FIGS. 2 and 3, they resiliently engage the internal surface 18 of the barrel 15 in a snug-fitting sealing relation to the interface 47. When disposed in an upwardly facing attitude with the second portions 80 thereof extending upwardly, the cups so disposed prevent or restrict the passage of fluid downwardly therepast and assist in carrying fluid upwardly upon upward movement of the plunger 10 within the barrel 15. Similarly, the downwardly facing cup members having their second portions 80 downwardly extending act to prevent or restrict the passage of fluid from the interface therepast in an upwardly directed path of flow.

Figure 3:
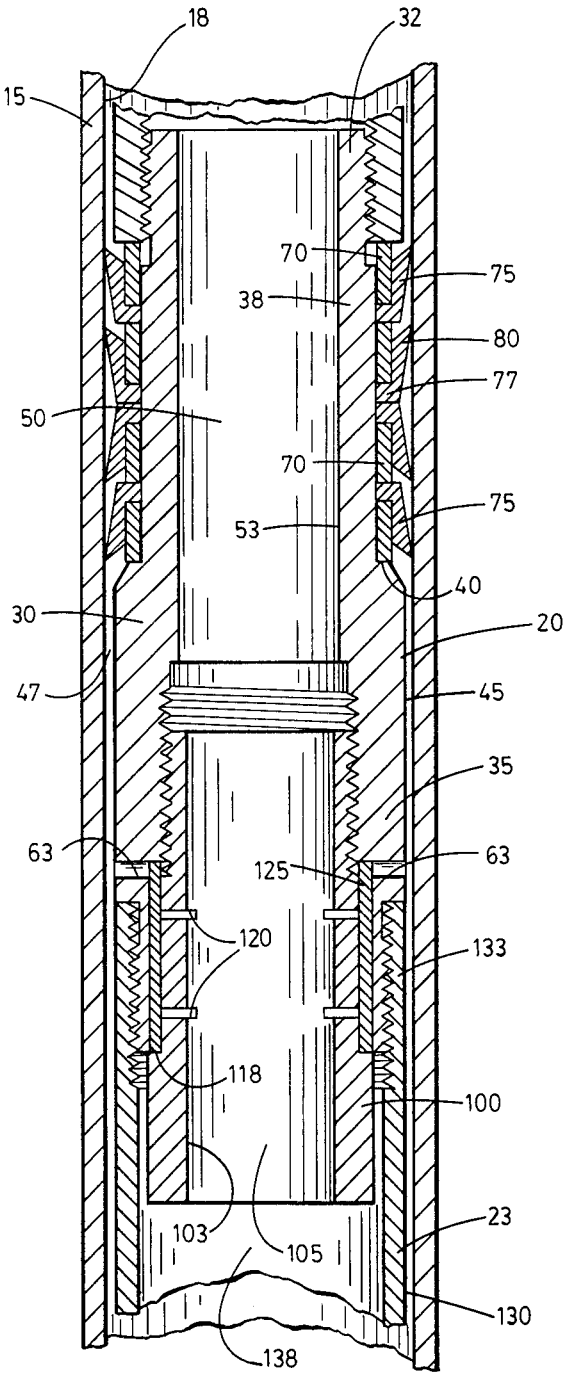
FIG. 3 is a somewhat enlarged portion of the transverse section of FIG. 2.

As can best be seen in FIG. 3, the first portions 77 of the cup members 75 are interposed between adjacent spacer rings 70.

As can best be seen in FIGS. 1 and 2, a cage 85 is provided by the upper portion 20 and is adapted for removable screw-threadable connection on the cage-mounting end portion 32 of the mandril member 30. The cage 85 provides an internal chamber 87 communicating externally of the cage through a plurality of apertures 89. An annular seat member 91 is dimensioned for insertion within the cage and is adapted to be biased in a fixed position between the cage-mounting end portion 32 and the cage upon screw-threaded connection of the cage to the cage-mounting end portion. The seat member is adapted to serve as a seat for a ball valve (not shown) to permit operation of the cage 85 in the manner of a conventional ball valve in operational environments where such valving action would be desirable. For most applications of the plunger 10 of the preferred embodiment, it is not believed that a ball valve operation of the cage 85 is necessary.

As can most clearly be seen in FIG. 3, the spacer rings 70 and cup members 75 are biased between the lowermost portion of the cage 85 and the shoulder 40 upon substantially complete screw-threaded attachment of the cage, whereby axial slippage of the rings and cup members is substantially prevented during the operation of the apparatus 10.

A second member or end piece 100 is screw-threadably secured on the filter mounting portion 35 of the mandril member 30. The end piece 100 provides a substantially smooth, cylindrical internal surface 103 bounding a bore 105 having an internal diameter slightly less than that of the internal surface 53 of the mandril member 30. The end piece 100 provides an externally screw-threaded first end portion 108 dimensioned for close-fitting, screw-threadable connection upon the internally screw-threaded portion of the internal surface of the mandril member. The end piece 100 further provides a neck portion 110 having a substantially cylindrical, external surface 112 having a diameter slightly less than that of the internal surface 58 of the screw-threaded union 55. The end piece 100 has a substantially cylindrical distal end portion 115 remote from the first end portion 108 externally dimensioned to define a shoulder 118 and to be disposed in snug-fitting, substantially fluid-tight relation against a portion of the internal surface 58 of the union 55. A plurality of slots 120 are provided communicating through the neck 110 and are disposed in spaced relation to each other. As can best be seen in FIGS. 1 and 3, the slots 120 extend incompletely about the circumference of the neck 110.

A filter element or filter member 125 is provided and is adapted to be captured between the neck 110 of the end piece 100 and the internal surface 58 of the screw-threaded union 55. Preferably, the filter member 125 is constructed of a porous material resistant to degradation upon exposure to hydrogen sulfide and other chemicals or extreme temperatures and pressure. The filter member is further preferably substantially flexible to permit wrapping thereof in substantially complete circumferentially circumscribing relation about the neck 110. Further, it is preferable that the material have a thickness greater than the chamber defined between the external surface of the neck 110 and the internal surface 58 of the union 55 whereby, upon interposition of the filter member 125 between the neck 110 and the internal surface 58 of the union 55, the material of the filter member is substantially compressibly biased therebetween to reduce the overall porosity thereof.

The intermediate portion 23 is substantially cylindrical in construction and has an external surface 130 having an outside diameter substantially equal to or slightly less than the greatest diameter of the filter mounting portion 35 of the mandril member 30. The intermediate portion 23 provides a first end portion 133 and an opposite, second end portion 135 spaced from the first end portion. The length of the intermediate portion can be varied as desired or as needed for a particular operational environment and will generally range from about one foot to four feet or more. The intermediate portion provides an elongated bore 138 extending axially substantially completely therethrough and communicating through the first and second end portions. The first end portion 133 is internally screw-threaded and is dimensioned for tight-fitting, screw-threadably removable connection on the screw-threaded union 55. The second end portion 135 is similarly internally screw-threaded and, as is described in greater detail below, is dimensioned for detachable, screw-threadable connection thereof on the lower portion 25.

The lower portion 25 provides a mandril member 145 having a predetermined proximal end portion 150 and an opposite, distal end portion 153 spaced from the proximal end portion. The proximal end portion 150 is externally screw-threaded and is dimensioned for substantially close-fitting, fluid-tight connection on the second end portion 135 of the intermediate portion 23. The mandril member 145 is substantially symmetrical about a longitudinal axis and provides an axially extending bore 155 disposed substantially concentrically about the longitudinal axis and communicating between the proximal end portion 150 and distal end portion 153.

The mandril member 145 has a shoulder portion 160 of predetermined external diameter, preferably substantially equal to that of the external surface 45 of the filter-mounting portion 35 of the upper portion 20. A neck portion 163 extends between the shoulder portion 160 and the distal end portion 153. The neck portion 163 is of lesser diameter than the shoulder portion 160. A plurality of spacer rings 170 and sealing members or cup members 175 preferably substantially similar to the rings 70 and cup members 75 borne on the upper portion 20, are slidably removably received on the neck portion 163. As are the cup members 75, the cup members 175 are dimensioned resiliently to engage the internal surface 18 of the barrel 15 in snug-fitting, substantially fluid-tight sealing relation to the interface defined between the barrel and lower portion. A plurality of the cup members 175 are disposed in upwardly facing attitudes with the remainder of the cup members 175 being disposed in an opposite downwardly facing attitude. Upon reference to FIG. 2, it will be seen that the uppermost of the cups 175 and the lowermost of the cups 75 bound and occlude the continuous interface defined between the shoulder 160; the intermediate portion 23; and the upper portion 20 and the internal surface 18 of the barrel 15.

A ball valve member 180 is screw-threadably secured on the distal end portion 153 of the mandril member 145. The ball valve member 180 provides a passage 183 axially therethrough and communicating with the bore 155 of the mandril member 145. The ball valve member has a predetermined first internally screw-threaded end portion 185 adapted for screw-threadable connection on the distal end portion 153 of the mandril member 145. A second internally screw-threaded end portion 187 is spaced remotely from the first end portion 185. A detent 190 is disposed in the first end portion 185 internally of the passage 183 substantially centrally thereof in non-occluding relation thereto to permit the passage of fluid through the passage and around the detent. A seat 193 is secured in the distal end portion and provides an aperture 195 therethrough to permit the flow of fluid through the aperture toward and away from the first end portion 185. A ball 198 is loosely captured within the passage 183 between the detent 190 and seat 193 for movement therebetween upon reciprocating motion of the plunger 10, as is described in greater detail hereafter. An externally screw-threaded end plug 200 providing an axial passage 203 therethrough is secured on the second end portion 187 and serves in part to bias the seat 193 in position.

As can best be seen upon reference to FIG. 2, the apparatus 10 provides a substantially continuous bore or passage extending between the end plug 200 and the cage 85 for fluid flow therebetween.

Second Form

Figure 4:
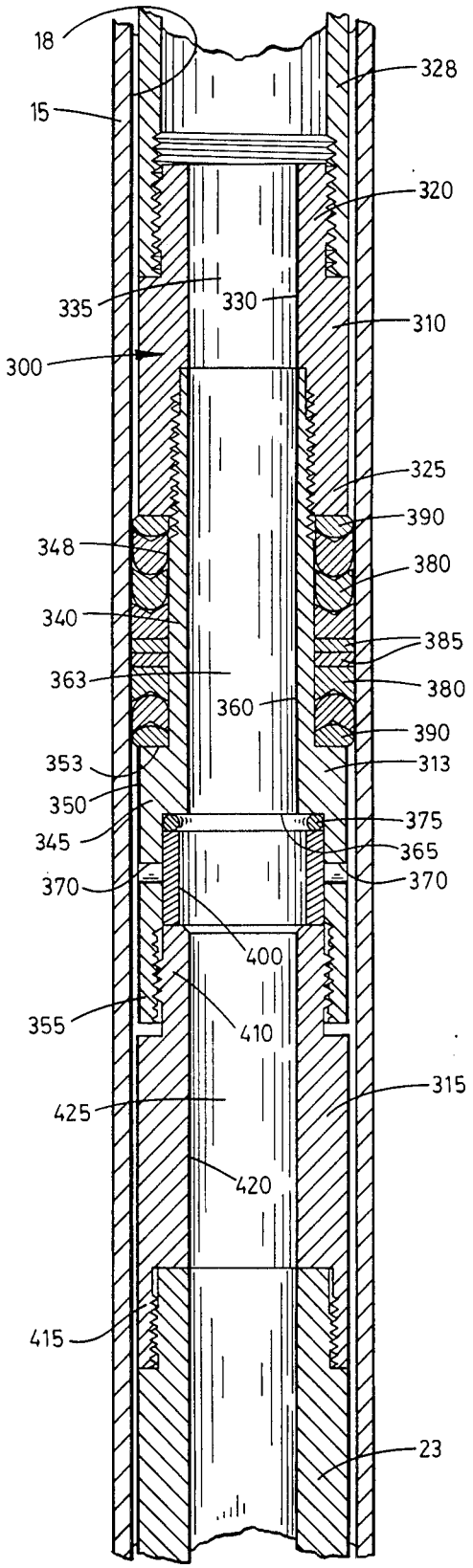
FIG. 4 is a somewhat enlarged view similar to FIG. 3 of a second form of the upper portion of the apparatus of the preferred embodiment.

A second form of the upper portion of the preferred embodiment is illustrated in longitudinal section in FIG. 4 and is designated generally by the numeral 300 therein. As shown in FIG. 4, the upper portion 300 is depicted deployed in an operative environment similar to that in which the first form 10 is shown in FIGS. 2 and 3. That is, the upper portion 300 is shown deployed for reciprocal axial movement thereof within a substantially cylindrical barrel 15 having a substantially smooth, internal surface 18.

The upper portion 300 provides a first portion 310; a second portion 313; and a filter retention member or third portion 315.

The first portion 310 has a predetermined first or upper end portion 320 and an opposite, second or lower end portion 325. The upper end portion 320 is externally screw-threaded and is dimensioned for substantially fluid-tight, screw-threadable connection on the lowermost end of a tubing string 328 or the like. The lower end portion 325 is internally screw-threaded and has an outer diameter slightly less than the internal diameter of the barrel 305 to permit slidable reciprocation of the first portion 310 within the barrel 305. The first portion 310 further provides an interior surface 330 of predetermined diameter bounding and defining a bore 335 extending axially therethrough. The second portion 313 provides a mandril portion 340 and a filter mounting portion 345. The mandril portion 340 has an external surface 348 of predetermined diameter. The filter mounting portion 345 provides an external surface 350 of greater diameter than that of the external surface 348 of the mandril 340, the diameter of the external surface 350 being slightly less than that of the internal diameter of the barrel 305 and further being substantially equal to that of the lower end portion 325 of the first portion 310. Thus, as can best be seen by reference to FIG. 4, the filter mounting portion 345 defines a shoulder 353 at the junction of the filter mounting portion and the mandril 340. The mandril portion 340 provides a distal end portion 355 remote from the filter mounting portion 345 and spaced therefrom a predetermined distance. The distal end portion 355 is externally screw-threaded and is dimensioned for fluid-tight, screw-threadable connection on the screw-threadable lower end portion 325 of the upper portion 310.

The second portion 313 has an internal surface 360 defining a bore 363 having a diameter substantially equivalent to that of the bore 335. The bores 335 and 363 are disposed substantially coaxially of each other when the upper portion 300 is assembled in an operative attitude, such as that illustrated in FIG. 4.

The filter mounting portion 345 of the second portion 313 is internally screw-threaded and provides a recessed annular seat portion 365 of greater diameter than the bore 363. The filter mounting portion 345 provides a plurality of weep holes or discharge passages 370 communicating radially therethrough between the bore 363 and the exterior of the filter mounting portion. An annular seal ring or O-ring 375 is snuggly fitted within the seat portion 365.

A plurality of sealing members 380 are closely received about the mandril portion 340 in stacked relation to each other. The sealing members 380 include a plurality of "chevron"-type rings disposed in oppositely facing directions. Interposed between the upwardly and downwardly facing sealing members are a pair of annular, substantially flat ring members 385. On opposite ends of the stack are a pair of end rings 390. While the seal members 380 are shown as being constructed having a chevron-type configuration, it is recognized that other forms of sealing members or cups of substantially conventional construction can be employed. Further, it is preferable that the sealing members be constructed of materials resistant to deterioration during the operation of the upper portion 300 due to friction against the surface 308 of the barrel 305 during the reciprocation of the plunger or due to environmental conditions, such as pressure, temperature and chemicals. Preferably, the sealing members 380 are dimensioned resiliently to be biased against the interior surface 308 during the operation of the plunger 300 in substantially fluid-tight relation to the interior surface. The number of sealing members utilized in the construction of the upper portion is not controlling and can be varied in accordance with the requirements of the environmental conditions and the needs of particular well conditions.

The sealing members 380 are tightly received about the mandril member 340 and are maintained against axial slippage therealong by abutment of the end rings 390 against the lower end portion 325 of the first portion 310 and the shoulder 353 of the second portion 313, respectively.

A filter element 400 is snuggly received in the seat portion 365 of the filter mounting portion 345. The filter element is preferably substantially cylindrical. In the construction of the filter element 400, it is preferable that a material such as oil impregnated, porous bronze, or other suitable, substantially rigid, porous material be employed. Preferably, the pores of the filter element form an interconnected, reticulated network communicating from the interior surface of the filter element through to the exterior surface of the filter element. Further, it is preferable that the dimensions of such pores and reticulations be micronic or submicronic. For instance, bushings currently commercially sold under the trademark "OILITE" are adaptable for use as filter elements. Such bushings are impregnated with oil which, under pressure, is adapted to be driven through the reticulated network and out of the bushing. Upon reference to FIG. 4, it will be seen that the filter element is operatively deployed in substantially covering relation to the weep holes 370 whereby fluids forced through the filter element from the bore 363 are caused to migrate toward and through the weep holes. Further, the filter element is preferably tightly biased at its upper and lower edges to prevent escape of fluids through the edges.

The third portion 315 of the upper portion 300 provides a predetermined first or upper end portion 410 and an opposite, second or lower end portion 415. The upper end portion is externally screw-threaded and is dimensioned for close-fitting, substantially fluid-tight, screw-threadable connection on the filter mounting portion 345. Upon complete screw-threadable connection of the third portion 315 and the second portion 313, the filter element 400 is compressibly biased between the O-ring 375 and the upper end portion 410 of the third portion 315.

The lower end portion 415 of the third portion 315 has an external diameter substantially equivalent to that of the filter mounting portion 345 and the lower end portion 325. The third portion 315 provides an internal surface 420 of predetermined diameter bounding and defining a bore 425 having a diameter substantially equivalent to that of the bores 363 and 335.

When the third portion 315 is secured to the second portion 313 in an operative attitude, the bores thereof are disposed substantially coaxially. Accordingly, it will be seen upon reference to FIG. 4 that the upper portion 300 of the second form provides a substantially continuous bore or passage of generally uniform diameter axially therethroughout.

The upper portion 300 is adapted to be connected in the manner of the upper portion 20 of the first form of the preferred embodiment on an intermediate portion substantially similar to that of the intermediate portion 23 of the first form and a third or lower portion constructed in the manner of that of the first form. Accordingly, in an assembled attitude, a plunger incorporating the upper portion 300 of the second form will include a lower portion mounting a plurality of cups or sealing members disposed to bound an interface area between the interior surface 18 of a barrel 15 when the plunger is installed in an operative attitude for reciprocation within such a barrel.

OPERATION

The operation of the described embodiments is believed apparent and is briefly summarized at this point.

Prior to placing the apparatus 10 in operation, it is secured on the lowermost end of a sucker rod or the like and introduced into the barrel 15 of the well bore. When the apparatus and rod have been lowered to a predetermined depth within the barrel wherein the well fluid is located, the sucker rod or tubing string is reciprocated axially within the barrel by means of a conventional walking beam-type actuating mechanism or other suitable means for causing such reciprocating motion.

As the lower portion 25 of the apparatus 10 enters and passes through the well fluid, the ball 198 is lifted from the seat 193 and carried into engagement with the detent 190. On the downstroke of the apparatus 10, fluid enters through the end plug 200 passing through the passage 203 thereof and through the aperture 195 past the ball 198 and into the bore 138 of the intermediate portion 23. From there, the fluid travels relatively to the downward movement of the plunger 10 through the bore 105 of the end piece 100 and into and through the bore 50 of the mandril member 30 to the cage 85 from which it exits into the barrel 15 through the apertures 89 of the cage.

The apparatus 10 and tubing string travel to the end of the downstroke, at which point travel reverses by operation of the walking beam or the like to cause the tubing string to carry the plunger 10 axially upwardly within the barrel 15. Fluid within the plunger exerts a counterforce by gravity against the ball 198 and forces it against the seat 193, sealing the aperture 195 and prohibiting the return of fluid by gravity through the end plug 200 into the well fluid.

During the downstroke of the apparatus 10, the downwardly facing cup members 175 borne on the mandril 145 substantially prevent or restrict the passage of fluid externally around the mandril, and permit fluid only to enter the apparatus through the end plug 200. Similarly, on the upstroke, the upwardly facing cups 75 on the mandril member 30 substantially prevent the return of fluid downwardly in the interface between the mandril and the interior surface 18 of the barrel 15.

With continued reciprocation of the apparatus 10, a column of oil-bearing well fluid begins to accumulate above the upper portion 20 within the barrel 15. The volume of the fluid added to the column with each upstroke and downstroke is largely a measure of the volume of fluid through which the apparatus passes on its downstroke; the length of the downstroke; and the internal volume of the apparatus. With each upstroke, the column of fluid within the barrel above the upper portion 20 is lifted and, as the volume increases, the hydrostatic pressure in the region of the apparatus proportionally increases. With increasing hydrostatic pressure, well fluid within the bore 105 of the endpiece 100 is caused to pass through the slots 120 into the filter member 125. Because of the compressed nature of the filter member, with its corresponding increased density and decreased porosity, the fluid must be forced to travel upwardly through the filter member toward the bores 63 in the mandril member 30. The compacted character of the filter member results in a somewhat creeping migration of the fluid within the filter member both circumferentially thereabout and upwardly therethrough. Further, because there are no radial openings through which the fluid can exit the filter member directly, passage of the fluid through the filter member is generally diffuse, and more remotely the slots and bores 63 are spaced from each other, the more diffuse is the flow of fluid in the filter member. Thus, particulate matter of micron and submicron sizes is substantially excluded from the fluid passing from the filter member 125 into the bores 63.

Filtered fluid exits the bores 63 and passes into the interfaces between the mandril member 30; the intermediate portion 23; and the mandril member 145, and the interior surface 18 of the barrel 15, and further bounded and sealed by the downwardly facing cup members 75 and upwardly facing cup members 175. Accordingly, a film of substantially clean, oil-bearing well fluid is captured between the interior surface of the barrel and the external surface of the apparatus, and is carried in axially reciprocal directions upon movement of the plunger. The film serves to lubricate the surface of the barrel to facilitate reciprocation of the plunger axially therein. Any fluid which escapes past the lowermost downwardly facing cup members 75 or uppermost upwardly facing cup members 175, is continually replenished by the passage of fluid through the filter member 125 and bores 63. Due to the efficient filtering of the fluid by the filter member, the fluid entering the space between the apparatus and barrel is substantially free of contaminants and particulate matter which otherwise could score the barrel and damage both the apparatus and the barrel, with a consequential necessity of removing the tubing string and the plunger for repair. The imposition of additional downwardly facing cup members 75 and upwardly facing cup members 175 further restricts the escape of fluid from the space between the plunger and the barrel.

Besides the advantage of providing means for filtering fluid for lubrication of the interface area between the apparatus 10 and the barrel 15, the apparatus provides additional advantages as well. The components of the apparatus 10 which are primarily susceptible to deterioration over the course of time with continued operation of the plunger are the cup members 75 and 175. While the cup members can be constructed of currently available materials having substantial resistance to wear upon repeated movement thereof upwardly and downwardly against the interior surface 18 of the barrel 15, it is anticipated that gradual erosion thereof is virtually inevitable. This is so even despite the fact that the fluid film in the interface area between the plunger and the barrel is efficiently cleansed of the vast majority of the particulate matter carried in the well fluid.

When replacement of one or more component parts of the apparatus becomes necessary, the plunger can be removed from the well barrel and unscrewed from the tubing string. At such point, a replacement plunger 10 can quickly be screw-threadably installed for reinsertion of the tubing string in the barrel. Alternatively, the defective component part can be quickly and easily replaced by unscrewing the component portions necessary for removal of the defective component and exchanging a new component piece for the defective one. For instance, if the filter member 125 becomes clogged with a sufficient amount of impurities to prevent the passage of fluid therethrough, upon removal of the apparatus 10 from the barrel 15, the upper portion 20 can quickly be screw-threadably disengaged from the intermediate portion 23. The end piece 100 is then easily unscrewed from the mandril member 30 to permit the simple removal of the filter member 125 and its replacement with a new, clean filter.

The filter member can be constructed of a variety of materials, as mentioned above. Further, although shown as being constructed in the form of a sheet adapted to be wrapped about the neck portion 110 of the end piece 100, the filter member can also be constructed in the form of a substantially cylindrical piece of material. However, it is seen that the filter member is most advantageously employed when construction in the form of that of the preferred embodiment illustrated and described herein. Preferably, the filter is of sufficient proportions to permit the overlaying of its opposite ends when wrapped about the neck portion 110. Thus, when the neck portion and filter member are inserted into the mandril 30 for screw-threadable attachment of the end piece 100, the screw-threadable motion of the end piece as it is rotated about its axis effects a shifting of the overlapping end over the other end to prevent buckling or bunching of the material which might otherwise permit more rapid flow of fluid through the filter member.

Accordingly, it is seen that the present invention provides a simply constructed and efficient means for minimizing damage to the plunger and barrel of a typical oil well which might otherwise occur due to accumulated sand and other particulate matter in the well fluid abrading the plunger and barrel upon reciprocation of the plunger in the barrel. Further, the apparatus of the present invention is adapted for quick and simple installation, as well as for easy replacement of damaged or defective component parts thereof. Moreover, the use of the apparatus of the present invention permits substantially continuous operation of the well without interruption for periods of greater duration than heretofore attainable employing conventional and known devices.

The operation of the apparatus 10 utilizing the upper portion 300 is essentially identical to that of the apparatus incorporating the upper portion 20. That is, as the lower portion 25 of the apparatus 10 enters and descends through the well fluid, the ball 198 is lifted from the seat 193 and carried into engagement with the detent 190. On the downstroke of the apparatus, fluid enters through the end plug 200 and passes through the passage 203 thereof upwardly through the aperture 195 around the ball 198 and into and through the bore 138 of the intermediate portion 123. The fluid then travels into and through the bore 425 of the third portion 315 and continues through the bore 363 of the second portion 313 and the bore 335 of the first portion 310 upwardly into the barrel.

Upon reversal of movement of the apparatus 10 wherein the tubing string 328 carries the apparatus 10 axially upwardly within the barrel 15, fluid within the apparatus exerts force against the ball 198 by gravity to cause it to seat substantially tightly against the seat 193 to seal the aperture 195 to prohibit the discharge of fluid through the end plug 200.

As a column of fluid bearing oil accumulates above the upper portion 300 within the barrel 15, the hydrostatic pressure of the fluid within the apparatus 10 increases. With such increase of pressure, fluid disposed within the upper portion 300 is forced into and through the porous filter element 400. Inasmuch as the filter element 400 is biased in substantially fluid-tight relation between the upper end portion 410 of the third portion 315 and the O-ring 375 in the seat portion 365, the flow of fluids within the filter element is substantially radially thereof. Fluid is then discharged by pressure through the external surface of the filter element 400 at the passages 370 and the fluid flows therefrom into the interface defined between the apparatus and the internal surface 18 of the barrel 15. Because of the relatively rigid structure of the filter element 400, and due to the controlled pore size of the reticulations therethrough, even micronic and submicronic particulate matter is excluded from passage therethrough, whereby substantially particle-free fluid exits therefrom for discharge through the passages 370.

Although the invention had been herein shown and described in what are conceived to be the most practical and preferred embodiments, it is recognized that departures may be made therefrom within the scope of the invention, which is not to be limited to the illustrative details disclosed.

Having described my invention, what I claim as new and desire to secure by Letters Patent is:

1. A plunger for pumping fluids against gravity within a well or the like of the type having an elongated tubular barrel providing a substantially cylindrical interior surface of predetermined diameter bounding a bore, the apparatus comprising:

a. a predetermined upper portion having a mandril member providing a substantially cylindrical external surface having a diameter less than that of the interior surface of the barrel to permit the mandril member operatively to be substantially loosely received within the bore of the barrel for reciprocal movement axially thereof and to define an interface between the external surface and the interior surface of the barrel, the mandril member further providing an internal surface bounding a primary bore of predetermined dimensions communicating therethrough for the flow of fluids between the mandril member and the bore of the barrel upon reciprocal movement thereof, and providing a discharge passage communicating between the external surface and the internal surface; and a second member removably secured on the mandril member for movement therewith providing an external surface and an internal surface bounding a primary bore communicating with the primary bore of the mandril member for the flow of fluids between the primary bores, a portion of the external surface being configured to define a substantially cylindrical chamber of predetermined dimensions bounded partially by a portion of the internal surface of the mandril member communicating with the discharge passage, the second member providing at least one inlet slot disposed in fluid-flow communicating relation between the internal surface thereof and the chamber, the chamber providing a predetermined first portion and a second portion spaced from the first portion, said discharge passage communicating with the chamber in the first portion and at least one inlet slot communicating with the chamber in a portion spaced from the first portion;

b. a porous filter element removably captured in the chamber to restrain the movement of particulate material carried by fluid moving through the chamber;

c. an elongated intermediate portion secured in fluid-tight relation on the upper portion for movement therewith and having an external surface dimensioned for loose-fitting movement within the barrel in spaced relation to the interior surface thereof to define an interface therebetween communicating with the interface defined between the mandril member and the interior surface, the intermediate portion further providing an internal surface bounding a primary bore disposed in fluid-flow relation to the primary bore of the second member;

d. a lower portion secured on the intermediate portion for movement therewith and having an external surface dimensioned for loose-fitting movement within the barrel in spaced relation to the interior surface thereof to define an interface therebetween communicating with the interface defined between the intermediate portion and the interior surface, and an internal surface bounding a primary bore disposed in fluid-flow relation to the primary bore of the intermediate portion;

e. a valve mounted on the lower portion to restrict the flow of fluid by gravity through the primary bore thereof;

f. at least one sealing member mounted on the upper portion in slidable, substantially sealing relation to the interface between the mandril member and the interior surface of the barrel; and g. at least one sealing member mounted on the lower portion in slidable, substantially sealing relation to the interface between the lower portion and the interior surface of the barrel.

2. The apparatus of claim 1 wherein the second member provides a plurality of slots disposed in spaced relation.

* * * * *